US008853943B2

(12) United States Patent
Genz et al.

(10) Patent No.: US 8,853,943 B2
(45) Date of Patent: Oct. 7, 2014

(54) DYSPROSIUM-HALIDE-CONTAINING HIGH-PRESSURE DISCHARGE LAMP

(75) Inventors: Andreas Genz, Berlin (DE); Niels Gerlitzki, Ulm (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/812,164

(22) PCT Filed: Jul. 18, 2011

(86) PCT No.: PCT/EP2011/062220

§ 371 (c)(1), (2), (4) Date: Jan. 25, 2013

(87) PCT Pub. No.: WO2012/013527

PCT Pub. Date: Feb. 2, 2012

(65) Prior Publication Data

US 2013/0113372 A1 May 9, 2013

(30) Foreign Application Priority Data

Jul. 28, 2010 (DE) ..... 10 2010 038 537

(51) Int. Cl.

| | |
|---|---|
| ***H01J 61/20*** | (2006.01) |
| ***H01J 61/82*** | (2006.01) |
| ***H01J 61/34*** | (2006.01) |
| ***H01J 61/12*** | (2006.01) |

(52) U.S. Cl.

CPC ..... *H01J 61/20* (2013.01); *H01J 61/827* (2013.01); *H01J 61/34* (2013.01); *H01J 61/125* (2013.01)

USPC ..... 313/641; 313/571; 313/640

(58) Field of Classification Search

None

See application file for complete search history.

(56) References Cited

U.S. PATENT DOCUMENTS

| | | | | |
|---|---|---|---|---|
| 3,530,327 | A | 9/1970 | Zollweg et al. | |
| 4,929,863 | A | 5/1990 | Verbeek et al. | |
| 6,356,016 | B1 | 3/2002 | Suijker et al. | |
| 6,362,571 | B1 | 3/2002 | Suijker et al. | |
| 7,022,261 | B2 | 4/2006 | Hampden-Smith et al. | |
| 7,057,350 | B2 | 6/2006 | Lambrechts et al. | |
| 7,868,553 | B2 * | 1/2011 | Russell et al. | 313/640 |
| 8,358,070 | B2 * | 1/2013 | He et al. | 313/637 |
| 2011/0018420 | A1 | 1/2011 | Hartwig et al. | |
| 2011/0031880 | A1 * | 2/2011 | Russell et al. | 313/643 |

FOREIGN PATENT DOCUMENTS

| | | | |
|---|---|---|---|
| CA | 2156472 | A1 | 3/1996 |
| DE | 102009044514 | A1 | 5/2010 |
| JP | 57128446 | A | 8/1982 |
| JP | 06243825 | A | 9/1994 |
| JP | 08162068 | A | 6/1996 |
| JP | 0917393 | A | 1/1997 |
| WO | 2009075999 | A2 | 6/2009 |

OTHER PUBLICATIONS

English abstract of JP 57128446 A dated Aug. 10, 1982.
English language abstract of JP 06243825 A dated Sep. 2, 1994.
English language abstract of JP 0917393 A dated Jan. 17, 1997.
English language abstract of JP 08162068 A dated Jun. 21, 1996.

* cited by examiner

*Primary Examiner* — Ashok Patel

(57) ABSTRACT

A high-pressure discharge lamp may include a quartz glass bulb which encloses a discharge volume, and a fill which contains mercury and noble gas as well as metal halides being held in the discharge volume, wherein the fill contains both dysprosium halides and also oxyhalides of at least one of tungsten and mercury based on at least one of the halogens bromine and chlorine.

15 Claims, 3 Drawing Sheets

DYSPROSIUM-HALIDE-CONTAINING HIGH-PRESSURE DISCHARGE LAMP

RELATED APPLICATIONS

The present application is a national stage entry according to 35 U.S.C. §371 of PCT application No. PCT/EP2011/062220 filed on Jul. 18, 2011, which claims priority from German application No. 10 2010 038 537.9 filed on Jul. 28, 2010.

TECHNICAL FIELD

Various embodiments relate to a high-pressure discharge lamp. Various embodiments relate in particular to metal halide lamps. Such lamps are, in particular, high-pressure discharge lamps having a ceramic discharge vessel or a quartz glass vessel for general lighting.

BACKGROUND

WO 2009/075999 discloses a high-pressure discharge lamp in which a metal halide fill is used. In order to assist the cycle process, the high-pressure discharge lamp contains $WO_3$ or $WO_2X_2$ with X selected from Cl, Br, I. The discharge vessel is ceramic, and rare earth metals must be avoided. Similar content is found in U.S. Pat. No. 6,362,571 and U.S. Pat. No. 6,356,016.

U.S. Pat. No. 7,057,350 discloses a high-pressure discharge lamp in which a metal halide fill is used. The discharge vessel is ceramic, and rare earth metals may be used owing to the high wall loading, which releases oxides from the ceramic that can assist a cycle process.

JP 57-128 446 discloses a metal halide lamp which, in the case of a quartz glass discharge vessel, uses $WO_2I_2$ in order to assist the cycle process.

SUMMARY

Various embodiments provide a high-pressure discharge lamp, which has improved maintenance.

Various embodiments provide a high-pressure discharge lamp having a quartz glass bulb which encloses a discharge volume, a fill which contains mercury and noble gas as well as metal halides being held in the discharge volume, wherein the fill contains both dysprosium halides and also oxyhalides of tungsten and/or mercury based on the halogens bromine and/or chlorine.

The addition of $WO_3$ according to the prior art mentioned above restricts the rare earths to lanthanum, praseodymium, neodymium, samarium and cerium as well as combinations thereof. In lamps having a quartz glass discharge vessel, Dy is preferably used as the metal for the metal halide, either alone or in combination with other metals, which leads to particularly good color rendering in such lamps. An experiment with tungsten oxychloride and/or tungsten oxybromide revealed the surprising result of maintenance improvement in the case of medium-power lamps, which contain a fill in particular of the daylight type, above a color temperature of at least 4800 K. In particular, these lamps are capped on one side.

U.S. Pat. No. 7,057,350 obtains the oxygen from the ceramic of the discharge vessel. To this end, a high wall loading of more than 33 W/cm$^2$ is necessary. Various embodiments of the present disclosure function with wall loadings of from 12 to 28 W/cm$^2$ and quartz glass as the discharge vessel. In this case oxygen and halogen are added via $WO_2O_2$ or $WO_2Br_2$ or mercury oxyhalide, optionally also in combination. Also, the use of mixed W—Hg oxyhalides is not excluded.

Preferably, the proportion of the Dy halide in the fill is from to 80 wt %, in particular from 50 to 70 wt %. The filling quantity of oxyhalides of the Br or Cl lies between 0.5 and 0.02 mg/ml of bulb volume. In particular, it is between 0.5 and 0.05 mg/ml for 35 to 150 W lamps and between 0.25 and 0.02 mg/ml for lamps of more than 150 W. When going below these limit values, the maintenance improvement is too small, and when exceeding them the color temperature and luminous flux decrease too greatly.

The concept according to various embodiments is suitable above all for lamps of low and medium power in the range of from 35 to 1000 W, in particular from 100 to 500 W.

Essential features of various embodiments, in the form of a numbered list, are:

1. A high-pressure discharge lamp having a quartz glass bulb which encloses a discharge volume, a fill which contains mercury and noble gas as well as metal halides being held in the discharge volume, characterized in that the fill contains both dysprosium halides and also oxyhalides of tungsten and/or mercury based on the halogens bromine and/or chlorine.
2. The high-pressure discharge lamp as in 1., characterized in that the proportion of the Dy halide is at least 40% and at most 80 wt % of the metal halide fill.
3. The high-pressure discharge lamp as in 1., characterized in that the metal halide fill furthermore contains halides of cesium and/or thallium and/or vanadium.
4. The high-pressure discharge lamp as in 1., characterized in that the fill is selected in such a way that a color temperature of at least 4800 K is achieved.
5. The high-pressure discharge lamp as in 1., characterized in that the wall loading of the discharge vessel lies in the range of from 12 to 28 W/cm$^2$.
6. The high-pressure discharge lamp as in 1., characterized in that the noble gas is argon, xenon, krypton or neon or mixtures thereof.
7. The high-pressure discharge lamp as in 1., characterized in that the discharge vessel is enclosed by an outer bulb. It is in particular bulbous.
8. The high-pressure discharge lamp as in 1., characterized in that the Hg content is selected to be in the range of from 1 to 30 mg/cm$^3$.
9. The high-pressure discharge lamp as in 1., characterized in that the filling quantity of oxyhalide lies in the range 0.02 mg/ml and 0.50 mg/ml, particularly in the range 0.02 mg/ml and 0.25 mg/ml.
10. The high-pressure discharge lamp as in 9., characterized in that the filling quantity of oxyhalide lies in the range 0.02 mg/ml and 0.25 mg/ml in the case of a power of at least 200 W.
11. The high-pressure discharge lamp as in 9., characterized in that the filling quantity of oxyhalide lies in the range 0.05 mg/ml and 0.50 mg/ml in the case of a power of from 10 to 175 W.
12. The high-pressure discharge lamp as in 1., characterized in that in the case of tungsten oxyhalide, the fill additionally contains Hg as an Hg compound, in particular as iodide, bromide, chloride or oxide.
13. The high-pressure discharge lamp as in 12, characterized in that the additional proportion of the Hg compound constitutes about 0.2 to 2 wt % of the amount of elemental Hg.

BRIEF DESCRIPTION OF THE DRAWINGS

In the drawing, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
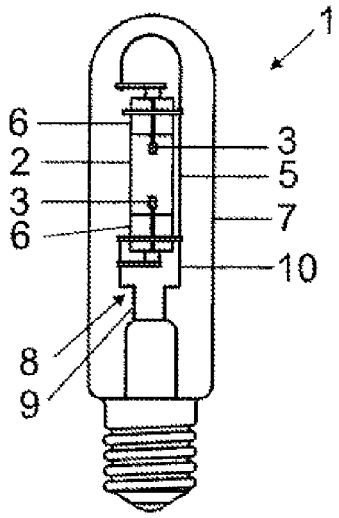
FIG. 1 shows a high-pressure discharge lamp having a discharge vessel with a cylindrical outer bulb.

FIG. 1 schematically shows a metal halide lamp 1 having a typical power of from 100 to 250 W. It consists of a quartz glass discharge vessel 2 having two ends 4, into which two electrodes 3 are inserted. The discharge vessel has a central part 5. At the ends, there are two pinch seals 6.

The discharge vessel 2 is enclosed by a cylindrical outer bulb 7. The discharge vessel 2 is supported in the outer bulb by means of a frame 8, which contains a short electrical conductor 9 and a long electrical conductor 10.

The discharge vessel contains a fill, which typically contains Hg (3 to 30 mg/cm$^3$) and from 0.1 to 1 mg/cm$^3$ of halide. As the noble gas, argon at a cold pressure of from 30 to 300 hPa is used.

Figure 2:
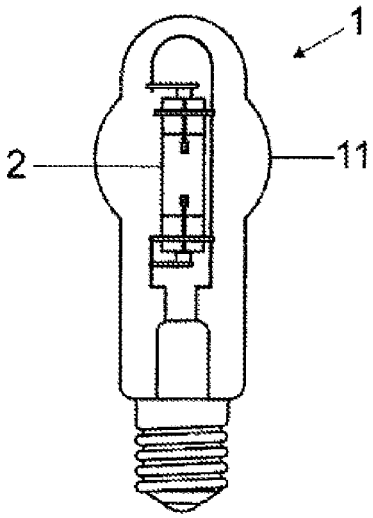
FIG. 2 shows a high-pressure discharge lamp having a discharge vessel with a bulbous outer bulb.

FIG. 2 shows a second exemplary embodiment of a lamp 1 having a quartz glass discharge vessel 2 for high powers of from 200 to 500 W, on which an outer bulb 10 that is bulbous in a central region 11 is fitted. The outer bulb is made of quartz glass, or alternatively hard glass.

The addition of tungsten oxides such as $WO_2$ or $WO_3$ according to the prior art mentioned above restricts the rare earths to lanthanum, praseodymium, neodymium, samarium and cerium as well as combinations thereof. In lamps having a quartz glass discharge vessel, Dy is preferably used as the metal for the metal halide, which leads to particularly good color rendering in such lamps. An experiment with tungsten oxychloride and/or tungsten oxybromide revealed the surprising result of maintenance improvement in the case of high-wattage lamps, the fill of which contains for example 61 wt % of dysprosium iodide. The tungsten oxyhalide filling quantity lies between 0.5 and 0.05 mg/ml bulb volume for 35 to 150 W lamps and between 0.25 and 0.02 mg/ml for lamps of more than 150 W.

The maintenance at 2500 h of this lamp with a power of 400 W is 75% without tungsten oxyhalide. With addition of 0.5 mg of $WO_2Cl_2$, the maintenance after 2500 h is more than 100%.

The maintenance at 9000 h of a 250 W lamp having a cylindrical outer bulb according to FIG. 1 is 77% without tungsten oxyhalide. With addition of 0.2 mg of $WO_2Br_2$, the maintenance after 9000 h is 85% and remains more than 80% after 12,000 h. The EUP limit value is 80% after 12,000 h.

The specific technical lamp data of these two lamps are indicated in Tables 1 and 2.

TABLE 1

| Exemplary embodiment 250 W | With daylight fill |
|---|---|
| Luminous flux | 18,500 lm |
| Color temperature | 5500 K |
| Average lifetime | 12,000 h |
| Average maintenance | >80% after 12,000 h |
| Electrode spacing | 27.5 mm |
| Outer diameter of the DV | 18.0 mm |
| Wall loading entire SUR | 17 W/cm$^2$ |
| Wall loading between EOs | 24 W/cm$^2$ |
| Length of the DV | 32.0 mm |
| Volume of the DV | 5.2 ml |
| Fill gas Ar, cold fill pressure | 100 hPa |
| Outer bulb fill gas | Vacuum |
| Fill in the discharge vessel | 15.0 mg Hg, 0.90 mg CsI, 3.35 mg $DyI_3$, 1.0 mg TlI, 0.20 mg $VI_3$ |
| Additive | 0.2 mg $WO_2Br_2$ |

(SUR = surface of the discharge vessel; EO = electrode; DV = discharge vessel)

TABLE 2

| Exemplary embodiment 400 W | With daylight fill, bulbous |
|---|---|
| Luminous flux | 35,000 lm |
| Color temperature | 5500 K |
| Average lifetime | 12,000 h |
| Average maintenance | >100% after 2500 h |
| Electrode spacing | 30.5 mm |
| Outer diameter of the DV | 24.0 mm |
| Wall loading entire SUR | 10 W/cm$^2$ |
| Wall loading between EOs | 17 W/cm$^2$ |
| Length of the DV | 46 mm |
| Volume of the DV | 14.5 ml |
| Fill gas Ar, cold fill pressure | 100 hPa |
| Outer bulb fill gas | vacuum |
| Fill in the discharge vessel | 60.0 mg Hg, 1.80 mg CsI, 6.70 mg $DyI_3$, 2.0 mg TlI, 0.40 mg $VI_3$ |
| Additive | 0.5 mg $WO_2Cl_2$ |

Figure 3:
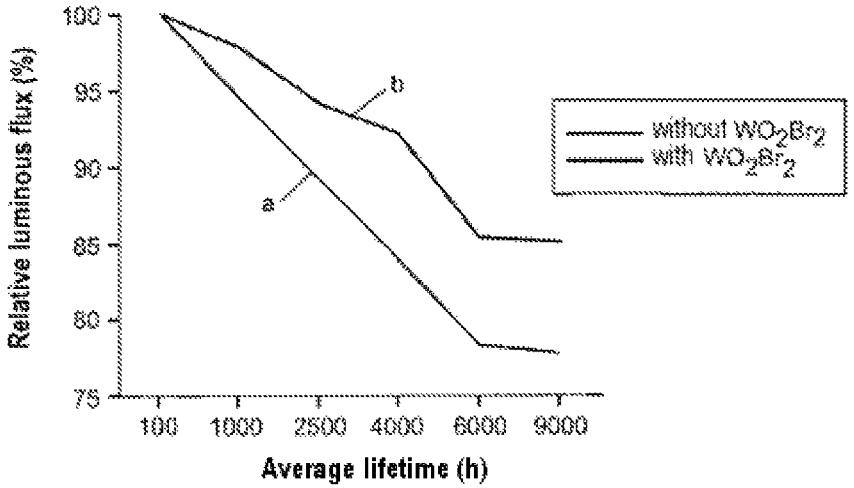
FIG. 3 shows a diagram which shows the maintenance for a fill with and without tungsten oxyhalide in the case of 250 W lamps.

FIG. 3 shows a diagram in which the maintenances of two fills for a 250 W lamp were compared with one another, normalized to the 100 h value of the luminous flux. It can be seen that a fill without tungsten oxyhalide (Curve a) by far exhibits an inferior behavior than the same fill with addition of tungsten oxyhalide, here selected as $WO_2Br_2$. With this fill (Curve b), a maintenance meeting EU standards is achieved.

Figure 4:
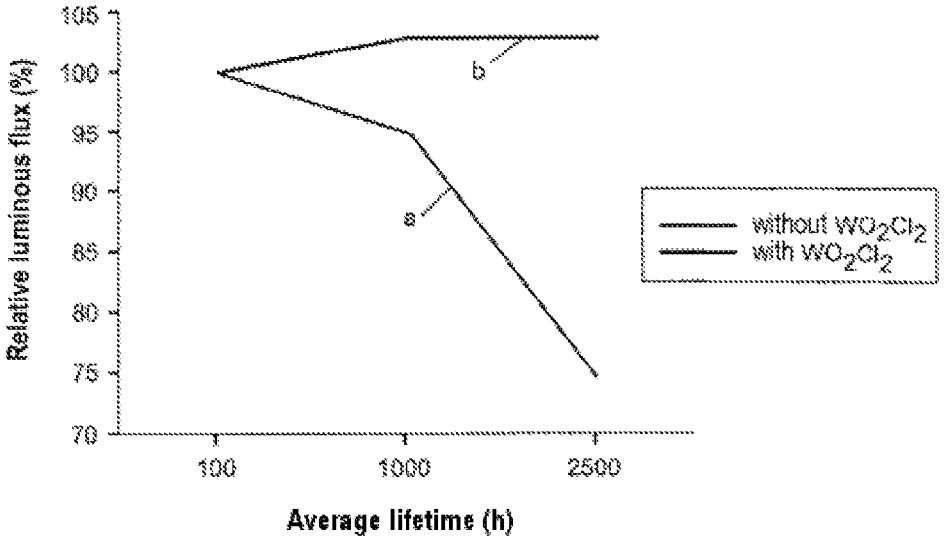
FIG. 4 shows a diagram which shows the maintenance for a fill with and without tungsten oxyhalide in the case of 400 W lamps.

FIG. 4 shows a diagram of 400 W lamps. It can be seen that a fill without tungsten oxyhalide (Curve A) by far exhibits a significantly inferior behavior than the same fill with addition of tungsten oxyhalide, here selected as $WO_2Cl_2$. With this fill (Curve b), a maintenance meeting EU standards is achieved, which does not display any reduction in the luminous efficiency over the timescale of up to 2500 h.

Figure 5:
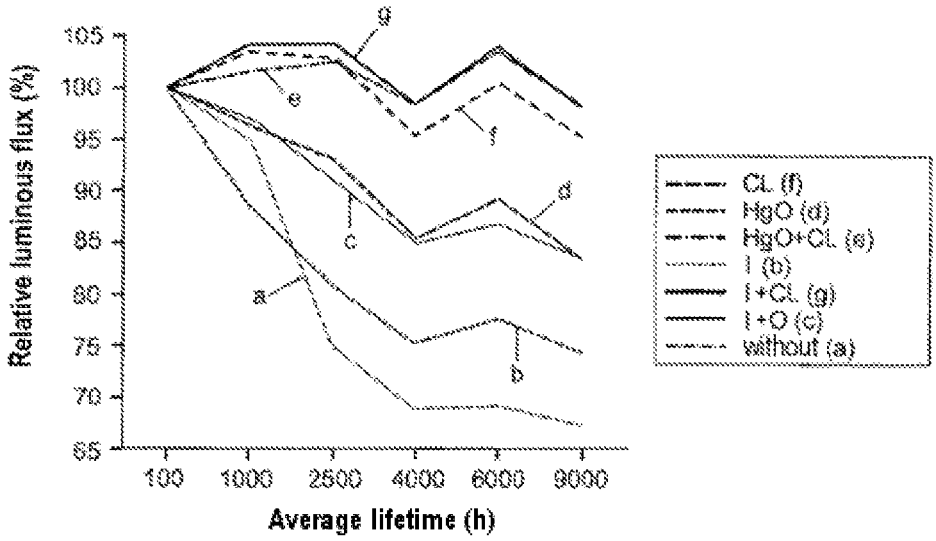
FIG. 5 shows a diagram which shows the maintenance for various fills in the case of 400 W lamps.

FIG. 5 shows a diagram in which various fills are compared with one another. The lamps are 400 W lamps. Fills according to Tab. 3 were compared with one another. $DyI_3$, CsI, TlI and $VI_3$ were used as metal halides (MH fill), in each case in a total of 8.4 mg. Hg was additionally added as an oxide or iodide, with or without tungsten oxyhalide, as indicated.

The groups with tungsten oxyhalide, here in particular $WO_2Cl_2$, deliver a very good maintenance of more than 80% at 2500 h to 9000 h, while the comparative group has a maintenance of only 75%, as previously usual. The additives indicated increase the burning voltage and reignition peak and reduce the color temperature. The other data correspond to those of Tab. 2.

TABLE 3

| Group | MH Fill | Additive |
|---|---|---|
| I + Cl (g) | 8.4 mg | 0.9 mg $HgI_2$ + 0.5 mg $WO_2Cl_2$ |
| HgO (d) | 8.4 mg | 0.5 mg HgO |
| HgO + Cl (e) | 8.4 mg | 0.5 mg + 0.5 mg $WO_2Cl_2$ |
| I (b) | 8.4 mg | 0.9 mg $HgI_2$ |
| Cl (f) | 8.4 mg | 0.5 mg $WO_2Cl_2$ |
| I + O (c) | 8.4 mg | 0.9 mg $HgI_2$ + 0.5 mg HgO |
| Without (a) | 8.4 mg | none |

FIG. 5 shows that outstanding results are achieved when adding tungsten oxyhalide in the form of oxychloride. An additional positive effect is obtained by further addition of an Hg compound in oxide form, as HgO. The use of $HgI_2$ does not show any positive effect on its own, but it does reinforce the effect of tungsten oxyhalides.

In a further embodiment, Hg is added in the form of oxychloride. The advantage of $Hg_3O_2Cl_2$ over the tungsten oxyhalides is the better dosability in a production line. Tables 4 and 5 indicate two exemplary embodiments for this, the discharge vessel consisting of quartz glass. As a fill component, vanadium halide in the form of $VI_2$, $VI_3$ or even $VI_4$ may in principle be used.

TABLE 4

Exemplary embodiment of 250 W metal halide lamp with daylight-like light color using $Hg_3O_2Cl_2$

| | |
|---|---|
| Power/W | 250 |
| Luminous flux/lm | 18,500 |
| Color temperature/K | 5500 |
| Average lifetime/h | 12,000 |
| Average maintenance | 80% after 12,000 h |
| Electrode spacing/mm | 27.5 |
| Burner bulb diameter/mm | 18.0 |
| Burner bulb length/mm | 32.0 |
| Bulb volume/ml | 5.2 |
| Wall loading/W/cm$^2$ | 17 |
| Fill gas burner | 100 hPa Ar |
| Outer bulb fill gas | vacuum |
| Fill in mg | 15.0 mg Hg, 0.90 mg CsI, 3.35 mg $DyI_2$, 1.0 mg TlI, 0.20 mg $VI_2$ |
| Additive | 0.6 mg $Hg_3O_2Cl_2$ |

TABLE 5

Exemplary embodiment of 400 W metal halide lamp with daylight-like light color using $Hg_3O_2Cl_2$

| | |
|---|---|
| Power/W | 400 |
| Luminous flux/lm | 35,000 |
| Color temperature/K | 5500 |
| Average lifetime/h | 12,000 |
| Average maintenance | 80% after 12,000 h |
| Electrode spacing/mm | 30.5 |
| Burner bulb diameter/mm | 24.0 |
| Burner bulb length/mm | 46.0 |
| Bulb volume/ml | 14.5 |
| Wall loading/W/cm$^2$ | 10 |
| Fill gas burner | 100 hPa Ar |
| Outer bulb fill gas | vacuum |
| Fill in mg | 60.0 mg Hg, 1.8 mg CsI, 6.7 mg $DyI_3$, 2.0 mg TlI, 0.40 mg $VI_2$ |
| Additive | 1.1 mg $Hg_3O_2Cl_2$ |

Figure 6:
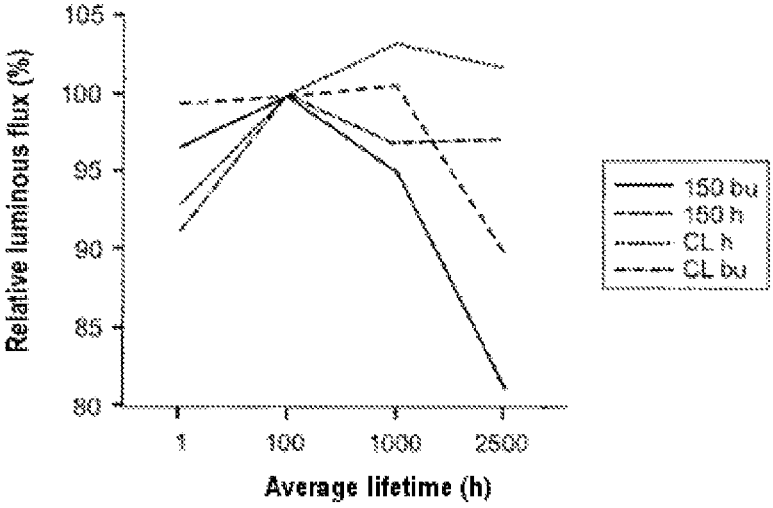
FIG. 6 shows a diagram which shows the maintenance for a fill with and without Hg oxyhalide in the case of 400 W lamps.

FIG. 6 shows a comparison of a fill according to Tab. 5, specifically once without addition ("150") and once with addition of Hg oxychloride ("CL") respectively for a horizontal and vertical burning position ("h" and "bu" respectively). The maintenance is very greatly improved by addition of Hg oxychloride.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp comprising: a quartz glass bulb which encloses a discharge volume, and a fill which contains mercury and noble gas as well as metal halides being held in the discharge volume, wherein the fill contains both dysprosium halides and also oxyhalides of at least one of tungsten and mercury based on at least one of the halogens bromine and chlorine.

2. The high-pressure discharge lamp as claimed in claim 1, wherein a proportion of a dysprosium halide is at least 40% and at most 80 wt % of the metal halide fill.

3. The high-pressure discharge lamp as claimed in claim 1, wherein the metal halide fill furthermore contains halides of at least one of cesium, thallium, and vanadium.

4. The high-pressure discharge lamp as claimed in claim 1, wherein the fill is selected in such a way that a color temperature of at least 4800 K is achieved.

5. The high-pressure discharge lamp as claimed in claim 1, wherein a wall loading of the discharge vessel lies in the range of from 12 to 28 W/cm$^2$.

6. The high-pressure discharge lamp as claimed in claim 1, wherein the noble gas is argon, xenon, krypton or neon or mixtures thereof.

7. The high-pressure discharge lamp as claimed in claim 1, wherein the discharge vessel is enclosed by an outer bulb.

8. The high-pressure discharge lamp as claimed in claim 1, wherein a mercury content is selected to be in the range of from 1 to 30 mg/cm$^3$.

9. The high-pressure discharge lamp as claimed in claim 1, wherein a filling quantity of oxyhalide lies in the range of from 0.02 mg/ml to 0.50 mg/ml.

10. The high-pressure discharge lamp as claimed in claim 9, wherein the filling quantity of oxyhalide lies in the range of from 0.02 mg/ml to 0.25 mg/ml in the case of a power of at least 200 W.

11. The high-pressure discharge lamp as claimed in claim 9, wherein the filling quantity of oxyhalide lies in the range of from 0.05 mg/ml to 0.50 mg/ml in the case of a power of from 10 to 175 W.

12. The high-pressure discharge lamp as claimed in claim 1, wherein in the case of tungsten oxyhalide, the fill additionally contains Hg as an Hg compound.

13. The high-pressure discharge lamp as claimed in claim 12, wherein an additional proportion of the mercury compound constitutes about 0.2 to 2 wt % of an amount of elemental Hg.

14. The high-pressure discharge lamp as claimed in claim 9, wherein the filling quantity of oxyhalide lies in the range of from 0.02 mg/ml to 0.25 mg/ml.

15. The high-pressure discharge lamp as claimed in claim 12, wherein said mercury compound is an iodide, bromide, chloride or oxide.

* * * * *